US010349766B2

(12) United States Patent
Van Asseldonk et al.

(10) Patent No.: US 10,349,766 B2
(45) Date of Patent: Jul. 16, 2019

(54) COVER DEVICE FOR A DRINK CONTAINER

(71) Applicant: KONINKLIJKE PHILIPS N.V., Eindhoven (NL)

(72) Inventors: Johannes Petrus Antonius Maria Van Asseldonk, Eindhoven (NL); Wiecher Ferdinand Kamping, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 91 days.

(21) Appl. No.: 15/316,969

(22) PCT Filed: Jun. 2, 2015

(86) PCT No.: PCT/EP2015/062296
§ 371 (c)(1),
(2) Date: Dec. 7, 2016

(87) PCT Pub. No.: WO2015/189074
PCT Pub. Date: Dec. 17, 2015

(65) Prior Publication Data

US 2017/0112309 A1 Apr. 27, 2017

(30) Foreign Application Priority Data

Jun. 12, 2014 (EP) ..... 14172197

(51) Int. Cl.
*A47G 19/22* (2006.01)
*B65D 47/20* (2006.01)
(Continued)

(52) U.S. Cl.
CPC ..... *A47G 19/2272* (2013.01); *B65D 43/0225* (2013.01); *B65D 47/06* (2013.01); *B65D 47/2031* (2013.01)

(58) Field of Classification Search
CPC ..... A47G 19/2272; A47G 19/2266; A47G 19/2205; A47G 19/22; B65D 47/00;
(Continued)

(56) References Cited

U.S. PATENT DOCUMENTS 3,941,149 A * 3/1976 Mittleman ..... A61M 39/24 137/493.1
4,660,747 A * 4/1987 Borg ..... A47K 5/122 137/844

(Continued)

*Primary Examiner* — Steven A. Reynolds
*Assistant Examiner* — Javier A Pagan

(57) ABSTRACT

A cover device (2) for a drink container having an improved leak resistance comprises a basic assembly (9) which is provided with a drink opening (32) and a ring-shaped member (37), and a valve arrangement (20) for blocking or unblocking a passage to the drink opening (32) from a drink container side of the cover device (2). The valve arrangement (20) comprises a valve element (26) having a sleeve (60) with a slit (42), a circumference of the sleeve (60) being substantially similar to a circumference of the ring-shaped member (37). The leak resistance of the valve arrangement is further improved in that the sleeve (60) and the ring-shaped member (37) have a first diameter in the direction of the slit (42) and a second diameter perpendicular to the slit (42), wherein a ratio between the first and second diameters of the sleeve (60) is smaller than a ratio between the first and second diameters of the ring-shaped member (37).

4 Claims, 4 Drawing Sheets

(51) Int. Cl.
*B65D 43/02* (2006.01)
*B65D 47/06* (2006.01)

(58) Field of Classification Search
CPC .... B65D 47/04; B65D 47/06; B65D 47/2018; B65D 47/2031
USPC ..... 220/711, 713, 714, 719
See application file for complete search history.

(56) References Cited

U.S. PATENT DOCUMENTS

| | | | | | |
|---|---|---|---|---|---|
| 4,711,365 | A * | 12/1987 | Fomby | B65D 41/0428 | 215/329 |
| 5,706,973 | A | 1/1998 | Robbins, III | | |
| 5,890,621 | A * | 4/1999 | Bachman | A47G 19/2272 | 215/11.4 |
| 6,092,551 | A * | 7/2000 | Bennett | F16K 15/147 | 137/843 |
| 6,357,620 | B1 * | 3/2002 | Hakim | A47G 19/2272 | 215/11.4 |
| 2007/0138121 | A1 * | 6/2007 | Stribling | A47G 19/2272 | 215/11.4 |
| 2015/0026507 | A1 | 1/2015 | Matsubara | | |

* cited by examiner

COVER DEVICE FOR A DRINK CONTAINER

This application is the U.S. National Phase application under 35 U.S.C. § 371 of International Application No. PCT/EP2015/062296, filed on Jun. 2, 2015, which claims the benefit of International Application No. 14172197.7 filed on Jun. 12, 2014. These applications are hereby incorporated by reference herein.

FIELD OF THE INVENTION

The present invention relates to a cover device for a drink container, comprising a basic assembly having a drink opening, and a valve arrangement. In an embodiment, the valve arrangement is associated with the basic assembly, and is adapted to assume various states for determining an extent to which a passage to the drink opening in the basic assembly from a side of the cover device which is intended to face the drink container is blocked.

The present invention also relates to an assembly of a drink container and a cover device as mentioned, wherein the cover device is removably attached to the drink container.

BACKGROUND OF THE INVENTION

PCT/EP2013/074796 describes a cover device for a drink container comprising a basic assembly which is provided with a drink opening and a valve arrangement for blocking or unblocking a passage to the drink opening from a drink container side of the cover device. The valve arrangement comprises a valve element having two portions which are connected to each other through an area of the valve element at a position where the valve element is hingably associated with the basic assembly, and wherein only one of the two portions is in direct communication with the drink opening of the basic assembly, so that a smallest total moment of force may be realized on the one portion when the valve element is subjected to pressure from the drink container side of the cover device. In the central portion a slit is present which will open upon suction force.

The thin material of the valve element at the location of the slit deforms when overpressure is present in the drink container on the valve element, sometimes resulting in opening of the slit. Overpressure occurs e.g. when the drink container is held upside down or is shaken.

SUMMARY OF THE INVENTION

It is an object of the present invention to provide a cover device for a drinking container with an improved leak resistance. The invention is defined by the independent claims. The dependent claims define advantageous embodiments.

The cover device according to the present invention comprises therefore a basic assembly having a drink opening and a ring-shaped member, a valve arrangement comprising a valve element having portions which are connected to each other through an area of the valve element at a position where the valve element is hingably associated with the basic assembly, wherein only one of the portions of the valve element is in direct communication with the drink opening of the basic assembly, and wherein sizing, positioning and orientation of the portions of the valve element are realized for having a smaller total moment of force on a portion of the valve element which is in direct communication with the drink opening of the basic assembly than on another portion of the valve element not being in direct communication with the drink opening, when the valve element is subjected to pressure from the side of the cover device which is intended to face the drink container and wherein the valve element comprises a sleeve, a circumference of the sleeve being substantially similar to a circumference of the ring-shaped member; wherein a slit is located inside the sleeve, the sleeve and the ring-shaped member having a first diameter in the direction of the slit and a second diameter perpendicular to the slit, and wherein a ratio between the first and second diameters of the sleeve is smaller than a ratio between the first and second diameters of the ring-shaped member.

The circumference of the sleeve is substantially similar to and matches therefore the circumference of the ring-shaped member. The sleeve can enclose the ring-shaped member. The sleeve can also be enclosed by the ring-shaped member. In this way a fluid tight seal between the sleeve and the ring-shaped member is achieved to prevent leakage of fluid from the container to the drink opening. The sleeve comprises a first diameter and a second diameter. The ring-shaped member comprises a first diameter and a second diameter as well. Both first diameters are in the direction of the slit and both second diameters are perpendicular to the slit and to the first diameters. The ratio between the first and second diameters of the sleeve is smaller than the ratio between the first and second diameters of the ring-shaped member. Consequently, during assembly the sleeve is stretched or widened in the direction of first diameter and compressed or narrowed in the direction of second diameter perpendicular to the first diameter. Because the slit is oriented on the valve element and in the direction of the first diameter of the sleeve, the slit is prestressed, when the sleeve is mounted onto to the ring-shaped member: the slit is stretched in the longitudinal direction along the first diameter of the sleeve and, consequently compressed in the direction of the second diameter of the sleeve. The sides of the slit are compressed against each other. The prestressing of the slit increases the threshold value for the slit to open. This increases the leak resistance of the slit and of the valve element.

Preferably the ring-shaped member is circular while the first diameter of the sleeve is smaller than the second diameter of the sleeve. When assembling the valve element and the basic assembly, the sleeve is mounted onto the ring-shaped member. Because the first diameter of the sleeve is smaller than the first diameter of the ringshaped member, which is equal to the second diameter of the ringshaped portion, the sleeve is stretched along its first diameter during assembly. The slit, which is oriented in the direction of the first diameter, is consequently stretched en prestressed in the direction of the first diameter. The stretching and prestressing of the slit increases the threshold value for the slit to open. This arrangement is advantageous for a user as he does not have to check upon assembly how to orient the valve element with respect to the basic assembly, because the tangential orientation of the valve element with repect to the basic assembly is not relevant: the slit will be prestressed at any orientation with respect to the ring-shaped member.

In another preferred embodiment the sleeve is circular while the first diameter of the ring-shaped member exceeds the second diameter of the ring-shaped member. The sleeve may be circular to match the circular shape of the valve element and/or the valve arrangement. A circular shape is less complicated to manufacture than a non-circular shape, e.g. the mold used for injection moulding may be easier to manufacture. Because the first diameter of the sleeve, which is equal to the second diameter of the sleeve, is smaller than the first diameter of the ringshaped portion, the sleeve is stretched along its first diameter during assembly. The slit, which is oriented in the direction of the first diameter, is consequently stretched en prestressed in the direction of the first diameter. The stretching and prestressing of the slit increases the threshold value for the slit to open.

An assembly of a drink container and a cover device is also provided.

These and other aspects of the invention will be apparent from and elucidated with reference to the embodiments described hereinafter.

BRIEF DESCRIPTION OF THE DRAWINGS

The present invention will now be explained in greater detail with reference to the figures, in which equal or similar parts are indicated by the same reference signs, and in which.

DETAILED DESCRIPTION OF EMBODIMENTS

Figure 1:
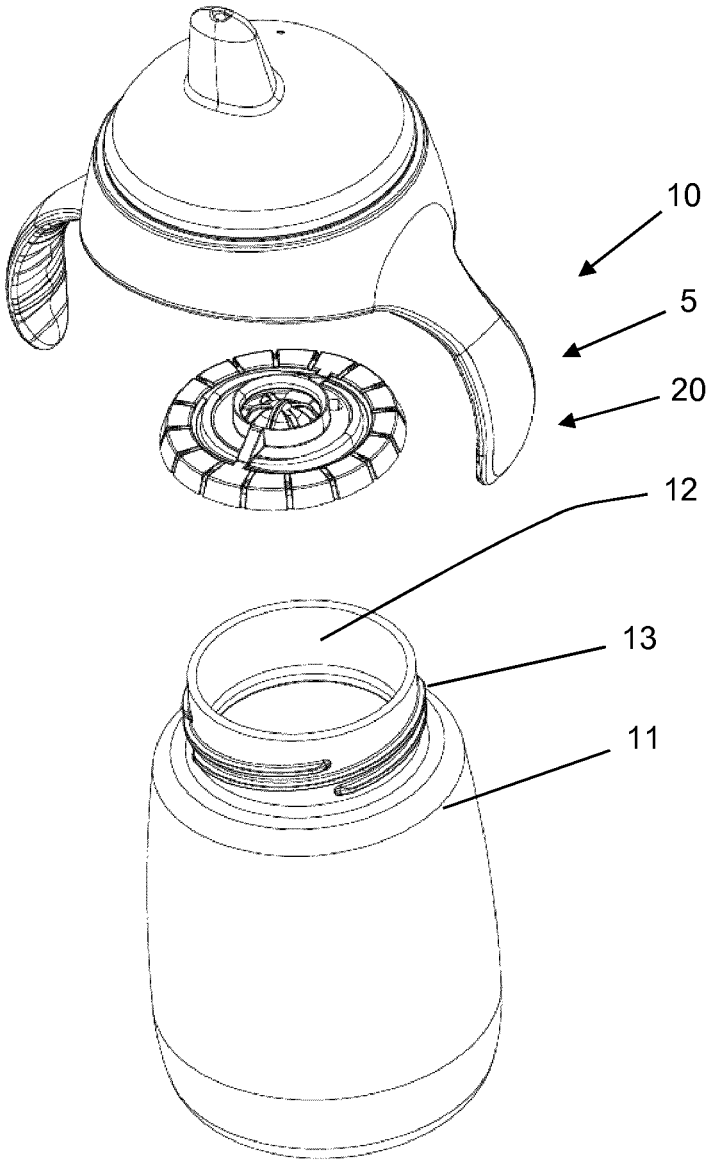
FIG. 1 shows an exploded view of a top portion of a drink bottle and a cover device according to an embodiment of the present invention.

FIGS. 1-6 relate to a cover device 5 according to an embodiment of the present invention. In general, the cover device 5 is intended to be used for covering an open side 12 of a drink container such as a drink bottle 11, wherein the cover device 5 has a function in avoiding spillage of liquid from the drink container 11. However, the cover device 5 is not just a cover having a sealing function. Instead, the cover device 5 comprises a valve arrangement 20 which is adapted to prevent liquid from flowing from an interior of the drink container 11 to outside of the drink container 11 through the cover device 5 in a closed state, and to allow a flow of liquid to pass through in an open state. In this way, it is possible to allow a user of an assembly 10 of the cover device 5 and the drink container 11 to drink from the drink container 11 if so desired without a need of removing the cover device 5, while the cover device 5 can perform a sealing function on the drink container 11 in all other circumstances.

Figure 2:
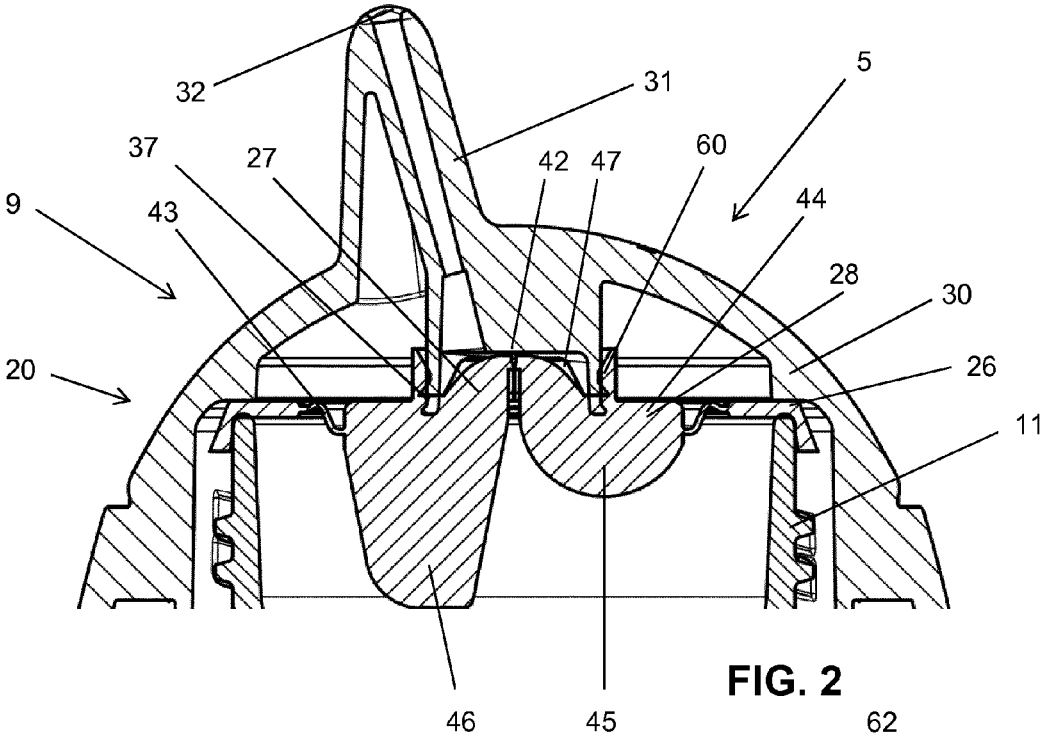
FIG. 2 illustrates a cross-sectional view of a cover device according to an embodiment of the present invention.
Figure 3:
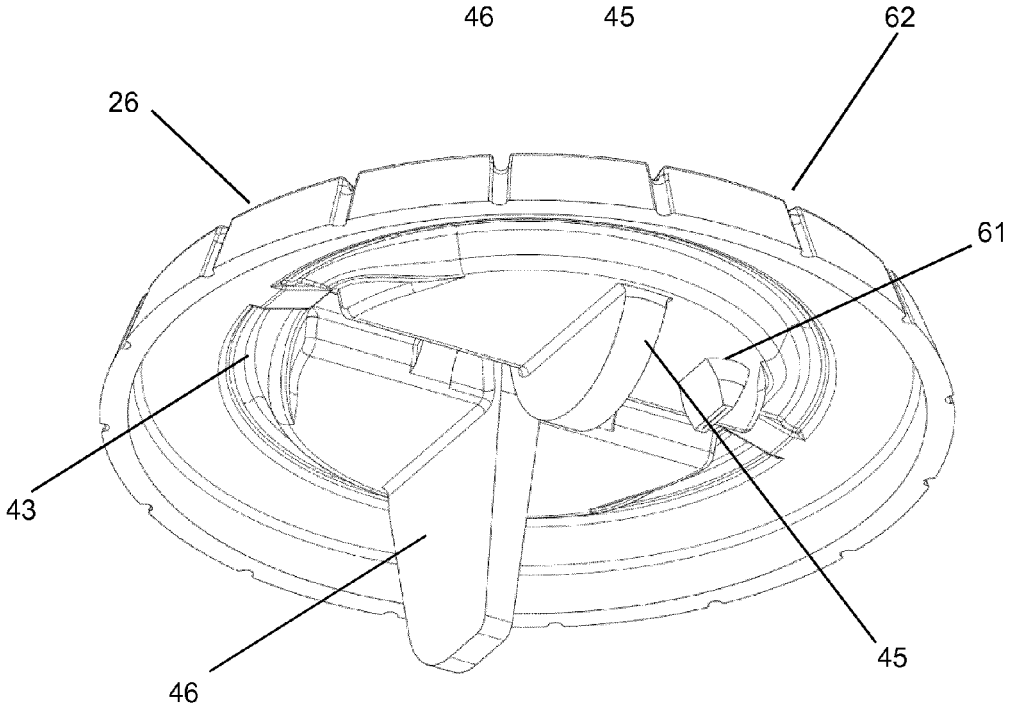
FIGS. 3 and 4 show perspective views of a valve arrangement of a cover device according to an embodiment of the present invention.

The cover device 1 comprises a housing 30 and a spout 31 which projects from the housing 30, wherein the spout 31 comprises at least one drink opening 32 and is intended to be inserted into the mouth of the user. It is noted that an assembly of the housing 30 and the spout 31 is also referred to as basic assembly 9 of the cover device 5. When the user exerts a sucking force on the spout 31, an underpressure is obtained in the spout 31 as a result thereof, which causes the valve arrangement 20 to open and allow the drink to pass from the drink container 11 to the user's mouth, wherein it is assumed that the user keeps the drink container 11 in a tilted orientation so that the drink is present at the location of the cover device 1. The details of the valve arrangement 20 will be explained later. FIG. 2 illustrates how the valve arrangement 20 is positioned in the cover device 5.

Within the framework of the present invention, the cover device 5 and the drink container 11 can be provided with any suitable type of means for allowing the cover device 5 and the drink container 11 to be attached to each other or to be detached from each other, depending on the user's desires. For example, both the cover device 5 and the drink container 11 can be provided with screw thread, wherein the drink container 11 can be provided with external screw thread 13 as shown in FIG. 1, and wherein the housing 30 of the cover device 1 can provided with internal screw thread for engaging with the external screw thread 13 of the drink container 11.

The cover device 5 comprises a basic assembly 9 including a housing 30 and a pout 31, which comprises at least one drink opening 32, and a valve arrangement 20. The valve arrangement 20 comprises a valve element 26. The housing 30 comprises a ring-shaped member 37 which serves for locally supporting the valve element 26 at a position between an inner periphery and an outer periphery of the valve element 26. The valve element 26 is arranged at the base of the spout 31. In particular, the ring-shaped member 37 contacts the valve element 26 only through a small area, so that a hinge contact is realized. Furthermore, the hinge contact between the valve element 26 and the ring-shaped member 37 of the housing 30 allows for changes in the position/orientation of the valve element 26 in the cover device 5 when pressure is exerted.

Figure 4:
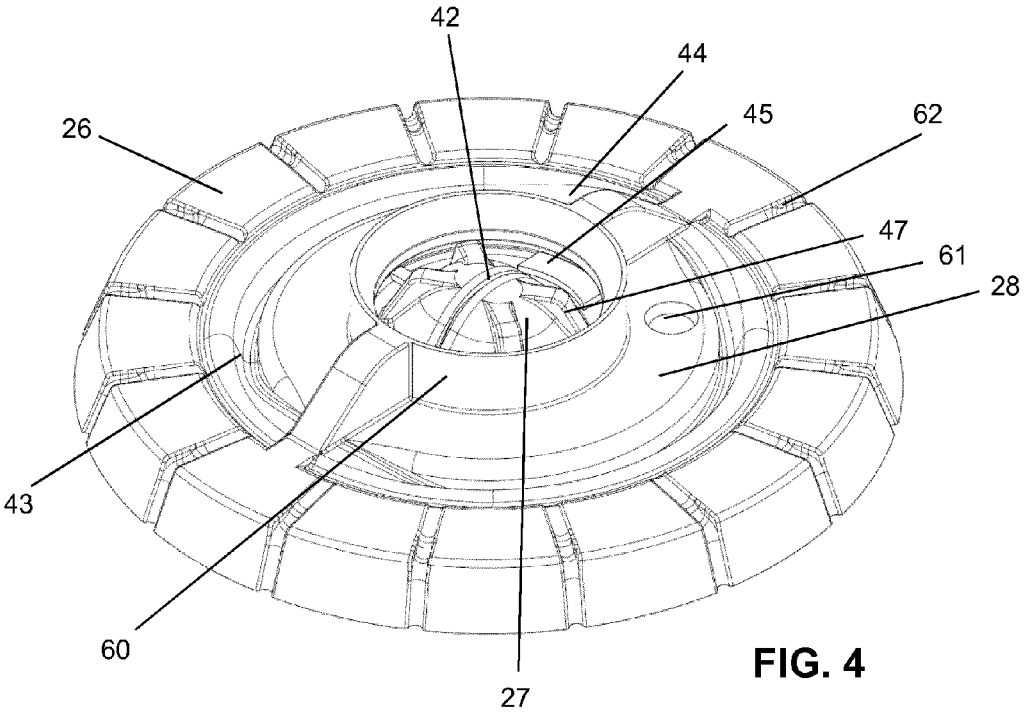
Figure 5:
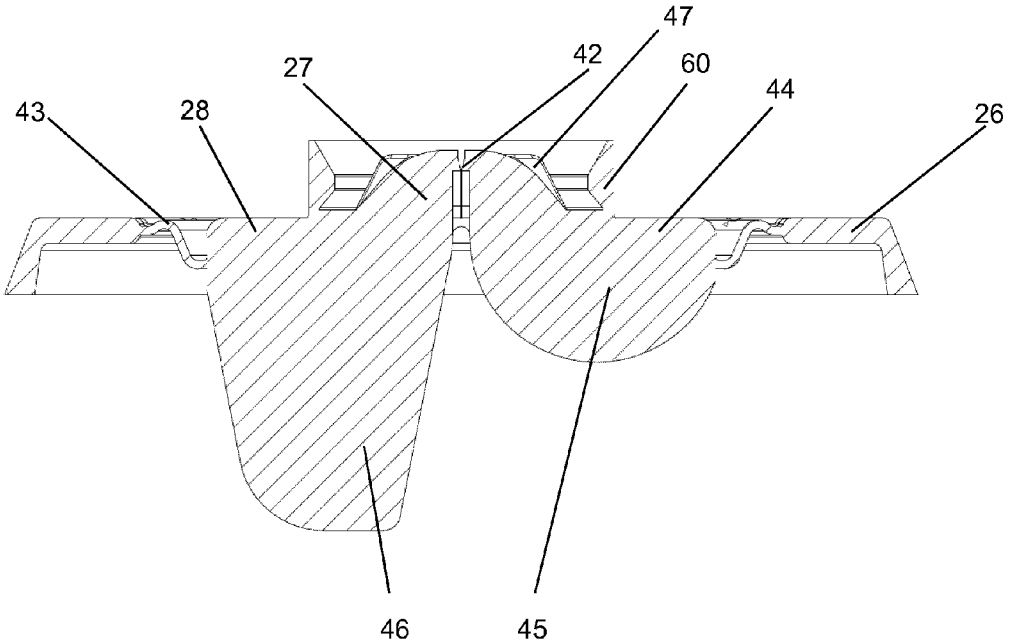
FIG. 5 shows a sectional view of a valve arrangement of a cover device according to an embodiment of the present invention.

The ring-shaped member 37 of the housing 30 divides the valve element 26 into two portions, as it were, namely a central portion 27 and an outer ring-shaped portion 28. As can be seen in FIG. 4, the central portion 27 is located in an interior space 38 of the housing 30 which is in direct communication with the spout 31, whereas the outer ring-shaped portion 28 is separated from that space 38 by the ring-shaped member 37. In other words, the central portion 27 is in direct communication with the drink opening 32 of the spout 31, whereas the outer ring-shaped portion 28 is not. As a consequence, when the user exerts a suction force on the spout 31 and thereby creates an underpressure in the spout 31, only the central portion 27 is under the influence of that underpressure, wherein the pressure difference across the central portion 27 causes a deformation and a tilting movement of the valve element 26, so that two sides of the slit 42 are pulled away from each other and the sealing contact of the slit 42 is lost. At that point, the valve arrangement 20 is in the open state. In order to enhance the tilting effect of the central portion 27, the outer ring-shaped portion 28 comprises a corrugated portion 43, so that a change of orientation of the central portion 27 does not require much force.

Another situation is obtained when overpressure is obtained inside the drink container 11, which may be the case when the drink container 11 is shaken or falls down, for example, in a situation in which the drink container 11 is filled to at least some extent. In the situation of overpressure as mentioned, a pressure difference is obtained across both the central portion 27 and the outer ring-shaped portion 28 of the valve element 26, as both portions 27, 28 are in communication with the interior of the drink container 11. The outer ring-shaped portion 28 is pressed in a direction of the spout 31 of the housing 30, and is deformed in such a way as to move in a space which is present between the drink container 11 and the ring-shaped member 37. The central portion 27 is under the influence of two factors, namely the pressure difference as mentioned and tensions which are a result of the deformation of the outer ring-shaped portion 28. The first factor tends to cause central portion 27 to assume a position in which the sealing contact between the two sides of the slit 42 are lost, whereas the second factor tends to cause the central portion 27 to tilt in the direction of the drink container 11 and assume a position in which the sealing contact to between the two sides of the slit 42 is intensified. The design of the valve element 26 is chosen such that the second factor is the strongest factor, so that a closed state of the valve arrangement 20 is guaranteed in the situation of overpressure prevailing at the side of the cover device 5 facing the drink container 11. Among other things, a design factor contributing to the influence of the outer ring-shaped portion 28 on the central portion 27 is the presence of one or more strengthening ribs 45,46 in the valve element 26 at the location of the hinge contact to the ring-shaped member 37 of the housing 30, by means of which a lever effect of the outer ring-shaped portion 28 on the central portion 27 is enhanced.

The closed state of the valve arrangement 20 is obtained on the basis of sealing contact of the two sides of a slit 42 provided in the valve element 26. The slit 42 is present in a dome-shaped, central portion 27 of the valve element 26. Thus, it is achieved that the central portion 27 having the slit 42 is in direct communication with the drink opening 32 of the spout 31, as shown in FIG. 2, whereas the outer ring-shaped portion 28 is not, as communication between the latter portion 28 and the drink opening 32 is blocked at a location where the valve element 26 hingably contacts the base of the spout 31, which is the location where the distinction between the central portion 27 and the outer ring-shaped portion 28 is made. Communication between the outer ring-shaped portion 28 and the drink opening 32 is also prevented by the presence of a sleeve 60, which encloses or is enclosed by the ring-shaped member 37 at the base of the spout 31. In the embodiment shown in FIG. 2 the sleeve 60 encloses the ring-shaped member 37. However, the opposite situation, the ring-shaped member 37 surrounding the sleeve 60 is also an option having a similar effect, namely preventing communication of fluid between the outer ring-shaped portion 28 and the drink opening 32.

Figure 6:
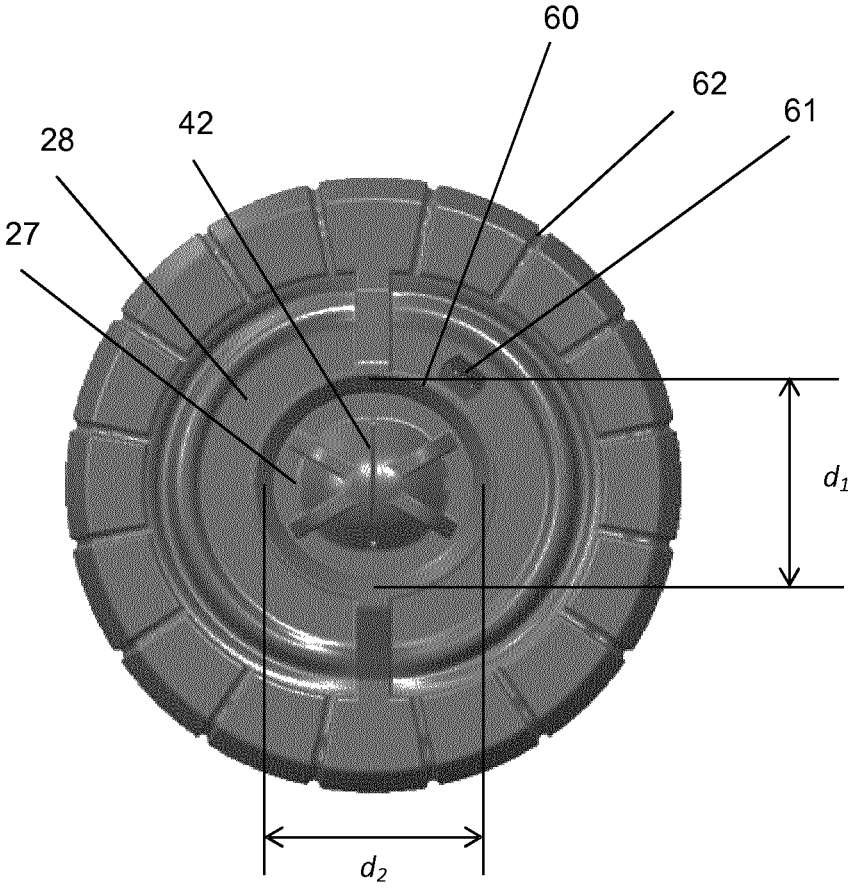
FIG. 6 shows top view of a valve arrangement of a cover device according to to an embodiment of the present invention.

The circumference of the sleeve 60 is of substantially the same size as the circumference of the ring-shaped member 37. The sleeve 60 and the ring-shaped member 37 have a first diameter in the direction of the slit 42 and a second diameter perpendicular to the slit 42. FIG. 6 illustrates a top view of the valve element and the orientation of the first and second diameters on the valve element. A ratio between the first and second diameters $d_1$, $d_2$ of the sleeve 60 is smaller than a ratio of the first and second diameters of the ring-shaped member 37. The ring-shaped member 37 can be elliptically shaped having a larger first diameter than the second diameter, while the sleeve 60 is circularly shaped, having a first diameter $d_1$ similar to the second diameter $d_2$. In this example the ratio of the ring-shaped member 37 is larger than 1, for example 1.1, while the ratio of the sleeve 60 is 1. The sleeve 60 can also be elliptically shaped having a smaller first diameter $d_1$ than the second diameter $d_2$, while the ring-shaped member 37 is circularly shaped. In this example the ratio of the sleeve is smaller than 1, for example 0.9, while the ratio of the ring-shaped portion 37 is 1. Another design option is to have both the ring-shaped member 37 and the sleeve 60 elliptically shaped on the condition that the ratio of the sleeve 60 is smaller than the ratio of the ring-shaped member 37. In this example the ratio of the ring-shaped member 37 is for example 1.1, while the ratio of the sleeve is for example 1.05. The difference in ratios between the ring-shaped member 37 and the sleeve 60 is such that, when, during assembly of the valve element 26 and the basic assembly 9, the sleeve 60 encloses or is enclosed by the ring-shaped member 37 and is stretched or widened along the first diameter $d_1$, and compressed or narrowed along the second diameter $d_2$. The slit 42 is consequently stretched in the direction of the first diameter $d_1$ and contracted in the direction of the second diameter $d_2$. The slit 42 stretched in the direction of the first diameter $d_1$ increases the threshold at which slit 42 opens and thus increases the leak resistance of the valve cover device 5. The ring-shaped member 37 having a larger first diameter than the second diameter, while the sleeve 60 is circularly shaped is preferred because the tangential orientation of the valve element 26 with respect to the basic assembly 9 is not relevant: the slit 42 will be prestressed at any orientation with respect to the ring-shaped member 37. This arrangement is beneficial to a user as he does not have to check upon assembly how to orient the valve element 26 with respect to the basic assembly 9.

The valve element 26 is provided with a valve 61 for allowing air to pass from one side of the element to the other. The valve 61 comprises a duckbill, for example. The valve 61 for allowing air to pass is arranged in the outer ring-shaped portion 28. The valve element 26 can also be provided with at least one, but preferably more than one, air channel 62. The air channels 62 for allowing air to pass are arranged on the edge of the valve element 26. The air channels 62 are suitable for air to pass, but are too small for liquid to flow from an interior of the drinking container 11 to outside of the interior of the drinking container 11. The valve element 26 can be provided with one or more air valves 61, with one or more air channels 61 or with a combination of both.

FIG. 2 illustrates how the valve element 26 is positioned with respect to the spout 31, and shows that the dome-shaped central portion 27 of the valve element 26 is present inside the spout 31 at the base of the spout 31. A sleeve 60 surrounds the central portion 27 of the valve element 26. The sleeve 60 is positioned around the ring-shaped member 37. The valve element 26 is held in its position and is prevented from moving by the sleeve 60 and the tight space between the drink container 11 and the cover device 5. For sake of completeness, it is noted that the valve element 26 may be retained inside the cover device 5 in any suitable manner, for example through a connection to the housing 30 at a position close to its outer periphery, or by means of a separate retainer.

When the spout 31 is subjected to a suction action and underpressure is prevailing in the spout 31 as a result thereof, a pressure difference is obtained across the valve element 26, which acts on the central portion 27 of the valve element 26. As a result, the central portion 27 is deformed as it is pulled further into the spout 31 to some extent, wherein the slit 42 automatically opens in view of the fact that portions surrounding the slit 42 are pulled apart, as it were. In this state, there is an open passage from one side of the valve element 26 to another, so that liquid may pass from the container side of the valve element 26 to the spout side. Due to the underpressure in the drinking container 11, caused by the suction action performed by a user through the drink opening 32 and the resulting open state of the valve arrangement 20, the air valve 61 opens so that the underpressure can be normalized due to an aeration effect. The underpressure can also be normalised by the air channels 62.

In a rest position of the valve element 26 in the cover device 5, the slit 42 is closed. In a situation of overpressure at the container side of the valve element 26, the slit 42 is closed as well, wherein an extra tight closure is realized under the influence of tensions prevailing in the valve element 26. In particular, in such a situation, a pressure difference is prevailing across the entire valve element 26, i.e. across both the central portion 27 and the outer ring-shaped portion 28. Under the influence of this pressure difference, the outer ring-shaped portion 28 is deformed to a considerable extent. The base of the spout 31 projects inside the housing 30 along a certain distance, and the outer ring-shaped portion 28 is pressed in a direction towards the basic assembly 9, thereby moving in a space which is present between the outer ring-shaped portion 28 and the housing 30 due to the projecting arrangement of the spout 31. The outer ring-shaped portion 28 may be provided with a corrugated portion 43 as is the case in the shown example, for locally weakening the outer ring-shaped portion 28 and guaranteeing a tilting movement of a portion 44 of the outer ring-shaped portion 28 as present between the corrugated portion 43 and the contact between the base of the spout 31 and the valve element 26. The tilting movement is continued in the central portion 27 of the valve element 26, wherein portions delimiting the slit 42 are tilted and deformed, as a result of which the central portion 27 is flattened similarly to the flattened central portion 27 of the third embodiment as illustrated in FIG. 12. As a result, the slit 42 is firmly closed, and a sealing function of the valve arrangement 20 as desired in the situation of overpressure is realized. The valve element 26 includes a number of strengthening ribs 45,46,47 as is the case in the shown example, so that the lever action of the outer ring-shaped portion 28 on the central portion 27 and consequently the closing of the slit 42 may be guaranteed despite of the flexibility of the valve element 26. The number of strengthening ribs 45,46,47 may vary dependent on for example the thickness of the valve element 26, the length in radial length and the width in tangential direction of the strengthening ribs. In the fifth embodiment the strengthening ribs 45,46,47 to support the lever action are located on the bottle side of the valve element 26 and on central portion 27. It is the objective of the strengthening ribs 45,46 to support the lever action of the secondary portion 28 on the primary portion 27 which is supposed to take place when overpressure is prevailing in a drink container 11 as covered by the cover device 5. The strengthening ribs 47 on the central portion 27 of the valve element 26 support the slit 42 in closing upon underpressure in the drink container 11. One of the strengthening ribs 46 may be an elongated strengthening rib 46, such that the rib 46 extends further from the valve element 26. The elongated strengthening rib 46 functions as a handle. The handle 46 enables a user to easily remove the valve element 26 from the cover device 5. The user can then easily clean the valve element 26 and the cover device 5.

Cover device 5 for a drink container 11 comprises a basic assembly 9 which is provided with at least one drink opening 32 and a ring-shaped portion 37. In a practical embodiment, the basic assembly 9 may comprise a housing 30 and a spout 31 which projects from the housing 30 and which has the drink opening 32 at a free end thereof. The cover device 5 further comprises a valve arrangement 20 which is adapted to assume a closed state for blocking a passage to the drink opening 32 in the basic assembly 9 from a side of the cover device 5 which is intended to face the drink container 11, and to assume an opened state for unblocking the passage as mentioned. In particular, the valve arrangement 20 comprises a valve element 26 comprising a sleeve 60 and a slit 42, a circumference of the sleeve 60 being substantially similar to a circumference of the ring-shaped member 37. The leak resistance of the valve arrangement is further improved in that the sleeve 60 and the ring-shaped member 37 have a first diameter in the direction of the slit 42 and a second diameter perpendicular to the slit 42, wherein a ratio between the first and second diameters of the sleeve 60 is smaller than a ratio between the first and second diameters of the ring-shaped member 37.

The valve arrangement 20 comprises a valve element 26 having portions 27, 28 which are connected to each other through an area of the valve element 26 at a position where the valve element 26 is hingably associated with the basic assembly 9, wherein only one of the portions 27, 28 of the valve element 26 is in direct communication with the drink opening 32 of the basic assembly 9, and wherein sizing, positioning and orientation of the portions 27, 28 of the valve element 26 are realized for having a smaller total moment of force on a portion 27 of the valve element 26 which is in direct communication with the drink opening 32 of the basic assembly 9 than on another portion 28 of the valve element 26 not being in direct communication with the drink opening 32, when the valve element 26 is subjected to pressure from the side of the cover device 5 which is intended to face the drink container 11.

Due to the fact the only one of the two portions 27, 28 of the valve element 26 is in direct communication with the drink opening 32 of the basic assembly 9, and the other of the two portions 27, 28 is not, it is possible to have different reactions of the valve element 26 on underpressure prevailing at a side of the valve element 26 which is associated with the drink opening 32, which is realized when a user wants to drink and exerts a suction force through the drink opening 32 for that purpose, and overpressure prevailing at a drink container side of the flexible element 26 even though the pressure differences across the valve element 26 can be comparable for both situations, at least as far as their direction is concerned. Due to this fact, it is possible for the cover device 5 to have a leakproof nature, while the valve arrangement 20 can be very well responsive to a suction action, so that the user is not compelled to exert a high suction force.

The different reactions of the valve element 26 in the different situations are obtained on the basis of the fact that in the first situation, only the portion 27 of the valve element 26 which is under the direct influence of the drink opening 32 of the basic assembly 9 is addressed, whereas in the second situation, both portions 27, 28 of the valve element 26 are addressed. In particular, the design of the valve element 26 and the design of the basic assembly 9 in which the valve element 26 is accommodated are chosen such that in the second situation, the portion 27 of the valve element 26 which is under the direct influence of the drink opening 32 is exerted to a lever action by the other portion 28 wherein the lever action is stronger than the inclination of the first portion 27 to respond to a pressure difference in the same way as in the first situation. Among other things, this effect may be achieved by letting the one portion 27 be smaller than the other portion 28, provided that distances of the one portion 27 to a hinge area are not very much larger than distances of the other portion 28 to the hinge area. In general, according to the present invention, sizing, positioning and orientation of the portions 27, 28 of the valve element 26 are realized for having a smaller total moment of force on a portion 27 of the valve element 26 which is in direct communication with the drink opening 32 of the basic assembly 9 than on another portion 28 of the valve element 26 not being in direct communication with the drink opening 32, when the valve element 26 is subjected to pressure from the side of the cover device 5 which is intended to face the drink container 11.

In respect of the thresholds for opening and closing the valve arrangement 20, it is noted that the values thereof may be determined by a design factor such as the position on the valve element 26 of the hinge association with the surface portion of the basic assembly 9.

In the examples as described in the foregoing with reference to the figures, the hinge association of the valve element 26 with the supporting surface portion of the basic assembly 9 is a hinge contact. That does not alter the fact that within the framework of the present invention, it is also possible for the hinge association to be a hinge connection. For example the valve element 26 may be connected to the ring-shaped member 37 instead of only contacting the ring-shaped member 37, wherein the connection is at a side of the valve element 26, at a position where the hinging effect takes place. Alternatively, a ring-shaped member can be provided as a standing part of a membrane, wherein the connection is at a top edge of the ring-shaped member. The hinging effect does not necessarily need to be present at the position of the connection. For example, in the latter case, the connection may be located at the top edge of the ring-shaped member, whereas a hinge may be present at a position at a bottom edge of the ring-shaped member, i.e. a position where the ring-shaped member is attached to the membrane, wherein the hinge may be realized by letting the ring-shaped member at the bottom side be sufficiently thin, to mention one possibility. In any case, it is possible to discern a valve element 26 which is arranged for assuming different positions/appearances with respect to the basic assembly 9 and thereby controlling an extent to which a passage to the drink opening 32 of the basic assembly 9 is blocked, wherein two portions 27, 28 can be distinguished on the valve element 26 which are separated by association to another element, which may be a separate element or an integral element, as explained in the foregoing, which has a function in suspending/supporting the valve element 26 from/on a supporting surface portion of the basic assembly 9, wherein the association is such that hinging movements of the element 26 are allowed to take place under the influence of the various possible pressures acting on the element 26.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

For sake of clarity, it is noted that the terms "overpressure" and "underpressure" as used in this text are understood such as to imply a higher pressure than ambient pressure and a lower pressure than ambient pressure, respectively.

Furthermore, it is noted that the basic assembly 9 does not necessarily need to be equipped with a spout 31, as long as it is possible for a user of the cover device 5 to drink from the drink opening 32 by exerting a suction force. It is practical for the drink opening 32 to be present at an end of an element projecting from a housing 30, as is the case with a spout 31, but this is not essential within the framework of the present invention.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A cover device for a drink container, the cover device comprising:
   - a basic assembly having a drink opening and a ring-shaped member; a valve arrangement, extending outwardly from the basic assembly, comprising:
   - a valve element comprising:
     - a raised central portion comprising a slit; and
     - an outer ring-shaped portion which are connected to each other through an area of the valve element at a position where the valve element is hingably associated with the basic assembly through contact to the ring-shaped member,
     - a sleeve extending upward from the ring-shaped member, said sleeve enclosing said raised central portion, and
     - a plurality of strengthening ribs extending from the sleeve along a surface of the raised central portion toward said slit, said strengthening ribs positioned on opposing sides of said slit;
   - wherein sizing, positioning and orientation of the raised central portion and the outer ring-shaped portion of the valve element are realized for having a smaller total moment of force on the raised central portion than on the outer ring-shaped portion when the valve element is subjected to pressure from a side of the cover device which is intended to face the drink container, wherein the sleeve and the ring-shaped member each have a first diameter in the direction of the slit and a second diameter perpendicular to the slit, and wherein a ratio between the first and second diameters of the sleeve is smaller than a ratio between the first and second diameters of the ring-shaped member.

2. The cover device according to claim 1, wherein the ring-shaped member is circular while the first diameter of the sleeve is smaller than the second diameter of the sleeve.

3. The cover device according to claim 1, wherein the sleeve is circular while the first diameter of the ring-shaped member exceeds the second diameter of the ring-shaped member.

4. An assembly of a drink container and a cover device according to claim 1, wherein the cover device is removably attached to the drink container.

* * * * *